US010460542B2

(12) United States Patent
Willard, II

(10) Patent No.: US 10,460,542 B2
(45) Date of Patent: Oct. 29, 2019

(54) SYSTEM AND METHOD FOR OPERATING A TRANSMITTER

(71) Applicant: GENTEX CORPORATION, Zeeland, MI (US)

(72) Inventor: Steven L. Willard, II, Holland, MI (US)

(73) Assignee: GENTEX CORPORATION, Zeeland, MI (US)

( * ) Notice: Subject to any disclaimer, the term of this patent is extended or adjusted under 35 U.S.C. 154(b) by 0 days.

(21) Appl. No.: 16/139,611

(22) Filed: Sep. 24, 2018

(65) Prior Publication Data

US 2019/0108702 A1 Apr. 11, 2019

Related U.S. Application Data

(60) Provisional application No. 62/570,964, filed on Oct. 11, 2017.

(51) Int. Cl.
*G07C 9/00* (2006.01)
*G08C 17/02* (2006.01)

(52) U.S. Cl.
CPC ..... *G07C 9/00309* (2013.01); *G07C 9/00714* (2013.01); *G08C 17/02* (2013.01); *G07C 2009/00412* (2013.01); *G07C 2009/00793* (2013.01); *G07C 2009/00928* (2013.01)

(58) Field of Classification Search
CPC . G07C 9/00309; G07C 9/00714; G08C 17/02
USPC ..... 340/5.61
See application file for complete search history.

(56) References Cited

U.S. PATENT DOCUMENTS

| | | | | |
|---|---|---|---|---|
| 6,662,077 | B2 | 12/2003 | Haag | |
| 7,269,416 | B2 | 9/2007 | Guthrie et al. | |
| 2002/0190872 | A1* | 12/2002 | Suman | G08C 17/02 340/12.22 |
| 2005/0195066 | A1* | 9/2005 | Vandrunen | G07C 9/00817 340/5.7 |
| 2010/0159846 | A1* | 6/2010 | Witkowski | G07C 9/00857 455/70 |

OTHER PUBLICATIONS

International Search Report dated Feb. 21, 2019, for corresponding PCT application No. PCT/US2018/052397, 3 pages.

* cited by examiner

*Primary Examiner* — Vernal U Brown
(74) *Attorney, Agent, or Firm* — Price Heneveld LLP; Bradley D. Johnson

(57) ABSTRACT

A communication system for communicating with a barrier operator for remotely controlling operation of a barrier. The communication system may include a remote device that can be handheld or incorporated into a vehicle. The communication system may also include a remote token separate from the remote device and capable of communicating information to the remote device. The remote device may be paired with a communication channel for communicating one or more commands to the barrier operator. The remote device may be configured to suppress or disable communication of a requested command on the communication channel until after information is received from the remote token that authorizes communication of the requested command on the communication channel.

20 Claims, 7 Drawing Sheets

SYSTEM AND METHOD FOR OPERATING A TRANSMITTER

CROSS REFERENCE TO RELATED APPLICATIONS

This application claims the benefit of and priority to U.S. Provisional Patent Application No. 62/570,964, filed on Oct. 11, 2017, entitled System and Method for Operating a Transmitter, the entire disclosure of which is hereby incorporated herein by reference.

TECHNICAL FIELD

The present application relates to barrier communication devices, and more particularly to a remote lockout feature for barrier communication devices.

BACKGROUND

Conventional barrier operators enable remote operation of a barrier in response to commands received from a conventional remote device via a communication interface. In other words, the conventional remote device may wirelessly communicate commands to the barrier operator to control operation of the barrier. The conventional remote device may be a handheld, portable device, or it may be integrated into a vehicle. This way, the remote device may be mobilized with respect to the vehicle and/or a user of the remote device. For instance, in the case of integration into the vehicle, the remote device may move with the vehicle and allow an operator of the vehicle to operate the barrier via the remote device. As a result, in this conventional approach, all that is needed for a user or a vehicle operator to operate the barrier is access to the remote device, either through the vehicle or in handheld form.

One downside to the conventional approach is that, if an unauthorized user gains access to the vehicle or the remote device in handheld form, the unauthorized user would be free to operate the barrier. As an example, a thief who steals a vehicle equipped with the conventional remote device would have the ability to operate the barrier without authorization. As another example, a household member that is not authorized to operate the barrier (e.g., a child) may still operate the barrier in the case where the household member gains access to the remote device, such as by gaining access to the vehicle.

SUMMARY OF THE DESCRIPTION

The present disclosure is directed to a remote device configured to control operation of a barrier operator, which in turn may control a barrier. One example of this configuration is a garage door opener configured to control opening and closing of a garage door.

In one embodiment, the remote device may include memory, a communication system, and a controller. The memory may be configured to store remote token information relating to a remote token, and to store one or more communication parameters pertaining to controlling operation of the barrier operator. The communication system may be configured to transmit communications to the barrier operator according to the one or more communication parameters, and to transmit a request for information to the remote token.

The controller may be configured to direct the communication system to transmit the request for information to the remote token, and to direct the communication system to transmit a command to the barrier operator according to the one or more communication parameters in response to receipt of information from the remote token that corresponds to the remote token information stored in memory. If the received information does not correspond to the remote token information stored in memory, the controller may prevent transmission of the command to the barrier operator. In some embodiments, the remote device may be an RFID device, and the request may include an interrogation signal transmitted from the remote device. The RFID device may transmit information corresponding to the remote token information via modulations imposed on the interrogation signal. In some embodiments, the remote token information is an identifier for the remote token, and the information received from the remote token is the identifier. The information received from the remote token may be encrypted according to a key and an encryption algorithm. The key may be a pre-shared key stored in both memory of the remote token and the memory of the remote device.

In another embodiment, a remote token is provided to communicate with a remote device for wirelessly directing operation of a barrier operator. The remote token may include memory, a communication system, and a controller. The memory may be configured to store identification information pertaining to an identity of the remote token, and the communication system may be configured to communicate wirelessly with the remote device. The controller may be configured to direct the communication system to wirelessly respond to a request from the remote device with token data that is based on the identification information stored in memory, where the token data authenticates the remote token to the remote device to authorize the remote device to wirelessly direct operation of the barrier operator.

In yet another embodiment, a method of communicating with a barrier operator includes providing a remote device for communicating a command to the barrier operator, where the barrier operator initiates an operation based on receipt of the command. The method may include providing a remote token separate from the remote device that is configured to communicate token data to the remote device in response to a request for the same. An input request may be received by a user via a user interface of the remote device. This input request may relate to a command for the barrier operator and initiate transmission of a token request to the remote token. In response to the token request, the token data may be transmitted from the remote token to the remote device.

The method may include determining if the token data is indicative of authorization for the remote device to transmit the command to the barrier operator to initiate operation according to the command. The method may include transmitting, based on that determining indicating the remote device is authorized to transmit the command, the command from the remote device to the barrier operator to initiate the operation.

In one embodiment, passive lockout capabilities are provided as a security measure that restricts transmission of one or more or all trained channels if a passive RFID authentication is not completed. The authentication may not be required to train a channel but only to transmit. The end user may place a system (e.g., a HomeLink system or module) into a passive lock-out mode to activate the authentication required step for transmission.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION

A communication system for communicating with a barrier operator for remotely controlling operation of a barrier is provided. The communication system may include a remote device that can be handheld or incorporated into a vehicle. The communication system may also include a remote token separate from the remote device and capable of communicating information to the remote device. The remote device may be paired with a communication channel for the barrier operator to communicate commands to the barrier operator. The remote device may be configured to suppress or disable communication of commands on the communication channel until after information is received from the remote token that relates to authorization for transmitting commands to the barrier operator via the communication channel.

I. Overview

Figure 1:
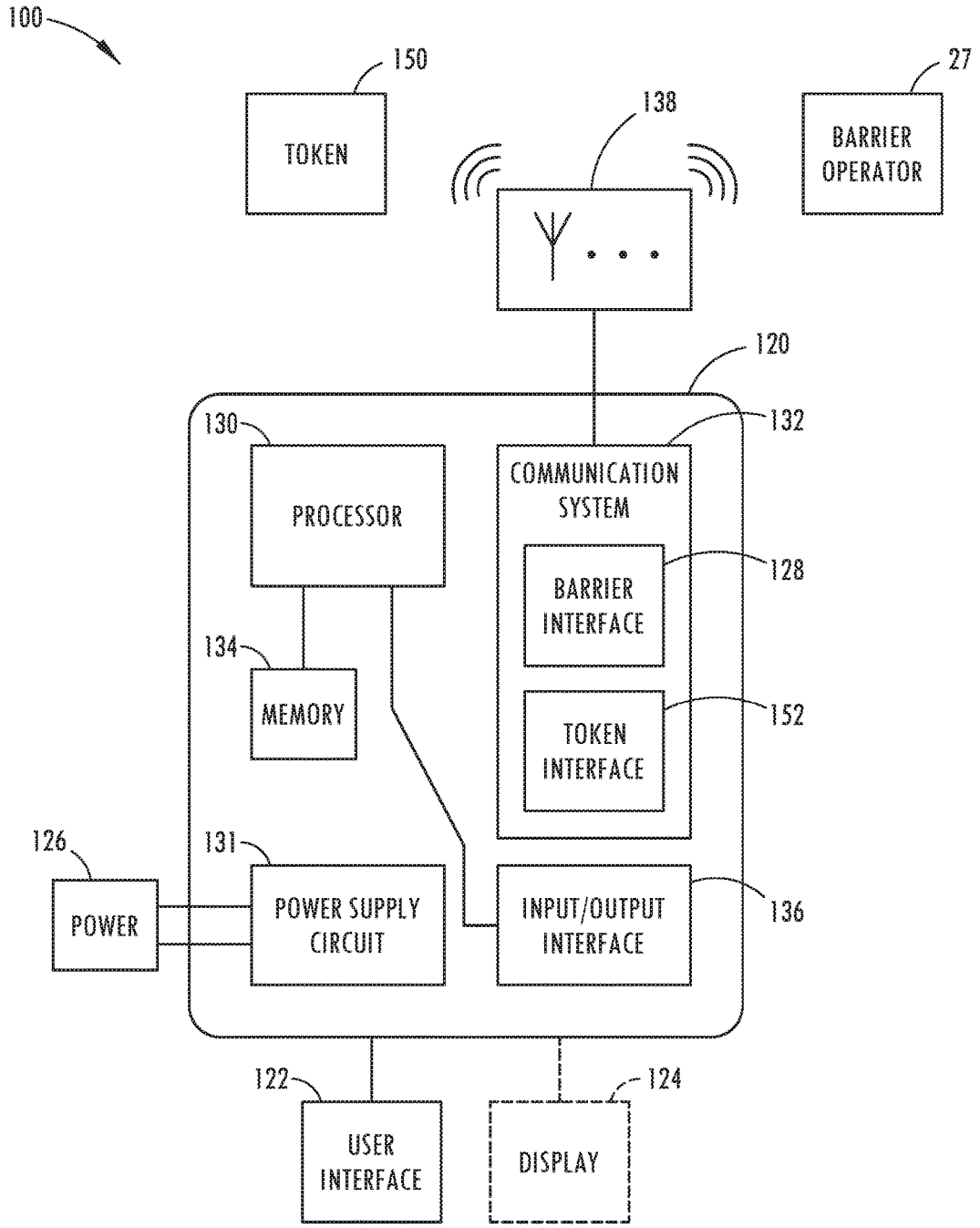
FIG. 1 depicts a representative view of a communication system in accordance with one embodiment.

The communication system for communicating with a remote electronic device is shown and generally designated 100 in the illustrated embodiment of FIG. 1. The communication system 100 includes the barrier operator 27, a remote device 120, and a token 150. The barrier operator 27 may be a garage door opener or any type of remote electronic device capable of performing an action in response to receipt of a command. The remote device 120 may be configured to communicate with the barrier operator 27 according to one or more communication protocols (e.g., KeeLoq or 128-bit AES-based formats). For instance, the remote device 120 may be configured to communicate according to the KeeLoq protocol, which implements a form of encryption to provide a degree of security against other devices (e.g., an unauthorized device) sniffing communications in an attempt to learn and replicate data that would otherwise be communicated by the remote device 120 according to the communication protocol, thereby gaining unauthorized access to the barrier operator 27.

In one embodiment, the remote device 120 may be configured to train to utilize one or more communication protocols for pairing with and operating the barrier operator 27. The remote device 120 may sniff communications between another device and the barrier operator 27 to learn the one or more communication protocols used by the barrier operator 27. It should be noted this learning process does not necessarily include learning to replicate the exact data that would be output from the other device—rather, the learning process may involve determining the one or more communication protocols used by the barrier operator 27 so that the remote device 120 may pair with the barrier operator 27 (separate from the other device) in accordance with the one or more communication protocols. The data output from the remote device 120 may be different from the data output from the other device but in accordance with the one or more communication protocols that were learned by sniffing communications from the other device to the barrier operator 27.

The token 150 may be separate from the remote device 120 and may be configured to enable the remote device 120 to transmit a command to the barrier operator 27 only if the token 150 is present in proximity to the remote device 120 and/or communicates token data related to authorization to transmit the command.

As an example, the token 150 may be provided on a keychain of a vehicle operator and the remote device 120 may be provided in the vehicle. The remote device 120 may be enabled to communicate a command to the barrier operator 27 only if the keychain is disposed within a vehicle cabin or in proximity to the vehicle. This way, if the keychain is not present in proximity to the remote device 120, the remote device 120 may not communicate a command to the barrier operator 27 (e.g., a command to open the barrier) despite a user's attempt to instruct the remote device 120 to send such a command. Presence and use of the token 150 may provide a degree of assurance that the remote device 120 is being instructed by an authorized user to communicate a command to the barrier operator 27. Presence detection may be determined in a variety of ways as discussed herein, including for example receipt of token data from the remote token 150 that corresponds to information stored in memory of the remote device 120 and associated with a communication channel for communicating commands to the barrier operator 27.

II. Remote Device

The remote device 120 may include a processor 130, memory 134, power supply circuitry 131, an input/output interface 136, and a communication system 132. The power supply circuitry 131 may be coupled directly to a power source of another object, such as a vehicle 10 depicted in the illustrated embodiment of FIG. 4. Alternatively, the power supply circuitry 131 may include a battery such that no external source of power is utilized for operation.

The input/output interface 136 may include one or more communication interfaces in addition to one or more communication interfaces provided in the communication system 132, including wired and/or wireless interfaces.

Examples of communication interfaces include discrete or analog inputs, discrete or analog outputs, $I^2C$ or other serial and wired interfaces, Bluetooth® transceivers, Wi-Fi transceivers, ZigBee transceivers, Z-Wave transceivers and 6LoWPAN transceivers.

The communication system 132, as described herein, may be coupled to a communication antenna system 138 and may be capable of communicating wirelessly according to one or more protocols compatible with the barrier operator 27. The communication antenna system 138 may include one or more antennas configured for communicating wirelessly via electromagnetic and/or inductive coupling with the barrier operator 27 and the remote token 150. The one or more antennas may be coupled respectively to a barrier interface 128 and a token interface 152 of the communication system 132.

In one embodiment, the remote token 150 may communicate with the communication antenna system 138 via inductive coupling in which an antenna of the communication antenna system 138 is a primary winding or inductor that provides power to the remote token 150 via a magnetic field and receives communication from the remote token 150 via the magnetic field. In this example, the remote token 150 may include a secondary winding or inductor that couples inductively with the primary winding or inductor. The remote token 150 may communicate information via this inductive coupling by changing an impedance of the remote token 150 in accordance with a modulation signal representative of encoded information. The modulation signal may be imposed on the interrogation signal. This type of modulation can be described as backscatter modulation. As compared to far field electromagnetic communication, inductive coupling may rely on close proximity for communication and power transfer. As a result, a user may need to place the remote token 150 in close proximity to an antenna of the antenna communication system 138 in order for the remote device 120 to communicate effectively with the remote token 150 and/or transmit power to the remote token 150. Proximity may be considered as a distance of 10 cm or less, possibly 2 cm or less, or as the remote token 150 being closer to the driver position than a vehicle mirror (e.g., rearview mirror and/or a side mirror external to the vehicle cabin). In one embodiment, to facilitate determining proximity with respect to the remote token 150 according to one or more of the criteria described herein, all or a portion of the communication antenna system 138 and optionally other components of the remote device 120 may be mounted near the ignition and/or the central console cup holder. In one embodiment, with all or a portion of the communication antenna system 138 being mounted inside or in close proximity to the ignition switch that accepts an operator's key, the operator may place the remote token 150 on her keyring and facilitate enabling the remote device 120 to identify proximity with respect to the remote token 150 when the operator places her key into the ignition switch.

In one embodiment, the token 150 may communicate with the communication antenna system 138 via electromagnetic radiation in the far field. The communication antenna system 138 in this configuration may wirelessly communicate a request via a far field communication channel and receive a response via the same or similar type of channel. For instance, the remote token 150 may utilize backscatter modulation over far field electromagnetic radiation from the remote device 120 to communicate information to the remote device 120. As another example, the remote token 150 may actively transmit electromagnetic radiation separate from transmissions of the remote device 150 in order to communicate information to the remote device 120.

With the communication system 132, including the barrier interface 128, the processor 130 may transmit and receive information or messages to and from the barrier operator 27. The processor 130 and memory 134 may be incorporated into a microcontroller, such as a Microchip PIC series microcontroller. It should be understood that the processor 130 and memory 134 may be separate devices depending on the application. The processor 130 may be configured to execute instructions retrieved from memory 134, including changing outputs and saving information in memory, permanently or temporarily, for use at a later stage in processing or conveying information to a user.

The processor 130 and memory 134 may be configured to utilize the communication system 132 to communicate wirelessly with the barrier operator 27. In one embodiment, the processor 130 and memory 134 may be configured for a training phase or mode in which a frequency and bit code format used by the barrier operator 27 are determined and stored as connection parameters. This information can be obtained from another device associated with the barrier operator 27, such as by sniffing information transmitted from the other device to the barrier operator 27.

The operational frequency band for communications with the barrier operator 27 may vary from application to application based on communication parameters obtained during the training phase. As an example, the frequency band may be between 286 MHz and 440 MHz with bands therein that may be avoided. In another example, the frequency band may allow bidirectional communications at larger power levels, such as a frequency band higher than 440 MHz. In one embodiment, the frequency band for communication with the barrier operator 22 may be in the range of 902-928 MHz, such as in the case of communications with the Chamberlain MyQ.

In the illustrated embodiment, the input/output interface 136 may be operably coupled to the user interface 122 to receive input from a user such as a vehicle operator, and optionally coupled to a display 124 to provide information to the user. The user interface 122 may include a plurality of discrete inputs, each associated with a function or inputs with multiple function capabilities that enable a user to select or direct operation of the remote device 120. The display 124 may enable the remote device 120 to aid the user in operating the user interface 122, or displaying status information relating to the status messages received from the barrier operator 27. Additionally, or alternatively, the display 124 may provide video information, such as video information obtained from a rearview camera of a vehicle. The display 124 may be at least one of an LED and LCD display and may be incorporated into a rearview mirror of a vehicle. In this configuration, one or more aspects of the display 124 may be selectively visible depending on whether they are activated. Alternatively, the display 124 may be separate from the rearview mirror 102.

III. Remote Token

Figure 2:
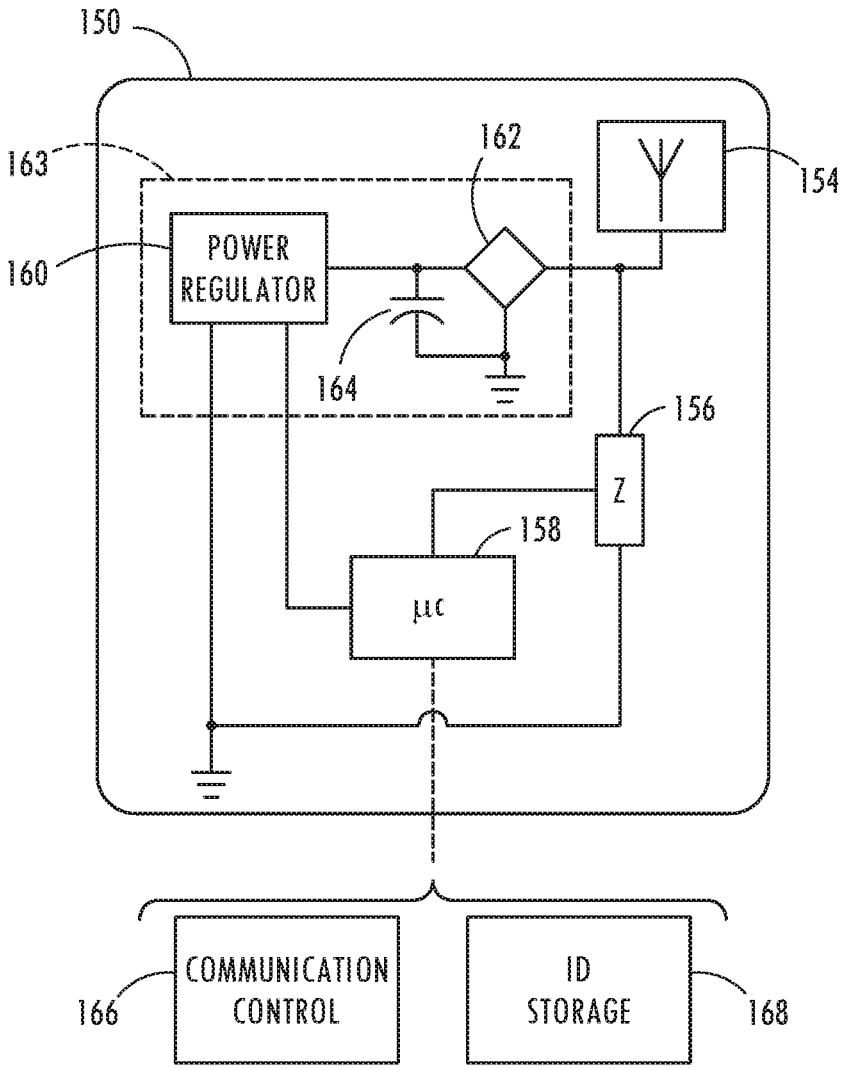
FIG. 2 shows a representative view of a remote token according to one embodiment.

The remote token 150 according to one embodiment is shown in FIG. 2. The remote token 150 is depicted as an RFID (radio-frequency identification) device—however, it should be understood that the remote token 150 may be any type of device capable of communicating wirelessly with the remote device 120. The RFID device in the illustrated embodiment is a passive RFID device that relies on power received from the remote device 120 for operation, but the RFID device can be configured differently as an active RFID device that relies on an internal power source.

The remote token 150 in the illustrated embodiment includes an antenna 154, which may be a secondary winding or inductor as discussed herein. The antenna 154 may be coupled to power conditioning circuitry 163 configured to provide power to a controller 158 based on energy received wirelessly in the antenna 154, described herein as the carrier wave. The controller 158 may respond to receipt of the carrier wave by modulating the carrier wave to communicate an identifier to the remote device 120. The carrier wave may be modulated by varying a load or impedance 156 coupled to the antenna 154. The load or impedance 156 may be varied in a variety of ways, such as by discretely switching the impedance 156 in or out of the circuit or gradually increasing or decreasing the impedance seen by the antenna 154, or a combination thereof. Variations in the impedance 156 in this manner may yield communications according to backscatter modulation techniques. The impedance 156 may be resistive, capacitive, or inductive, or a combination thereof.

The power conditioning circuitry 163 may include a rectifier 162, a conditioning capacitor 164, and a power regulator 160 configured to accept a varying or AC signal received in the antenna 154, and to generate a DC output suitable for powering the controller 158. The receipt of power sufficient to operate the controller 158 may be considered a request for information in one embodiment. Alternatively, or additionally, the carrier waveform may include encoded information that the controller 158 can decode and interpret. This encoded information may include a request to respond or communicate information to the remote device 120.

The controller 158 in the illustrated embodiment may include memory or identification storage 168 that stores identification information related to the remote token 150. The identification information may enable or authorize a communication channel of the remote device 120 to communicate a command to the barrier operator 27. The identification information may be provided by or based on information obtained from the remote device 120 during a pairing stage, or the identification information may be stored in memory at the time of manufacture, or a combination thereof.

The controller 158 may further include a communication controller 166 capable of controlling the impedance 156 to communicate the identification information obtained from identification storage 168. The communication controller 166 may be configured to encode the identification information, such as by PWM or Manchester encoding, and optionally to encrypt the identification information along with additional information (e.g., a rolling code or a nonce) to prevent a simple replay attack that may involve trying to mimic the remote token 150. The identification information may be encrypted according to a key and an encryption algorithm. The key may be a pre-shared key stored in both memory of the remote token 150 and the memory of the remote device 120.

In one embodiment, a user may be able to purchase the remote token 150 (e.g., an RFID tag) as an optional extra item for a vehicle, including for a HomeLink enabled vehicle, at the dealer or as an aftermarket item. An example of a remote token 150 is a keychain RFID tag with HomeLink logo on it. Each remote token 150 may be assigned a unique serial number or some other unique identifier assigned to the token's backscatter modulation (e.g., the token's RFID). The frequency ranges used by the remote token 150 may be in the 865-868 MHz (Europe) or 902-928 MHz (North America) range.

IV. Barrier and Vehicle Configuration

Figure 3:
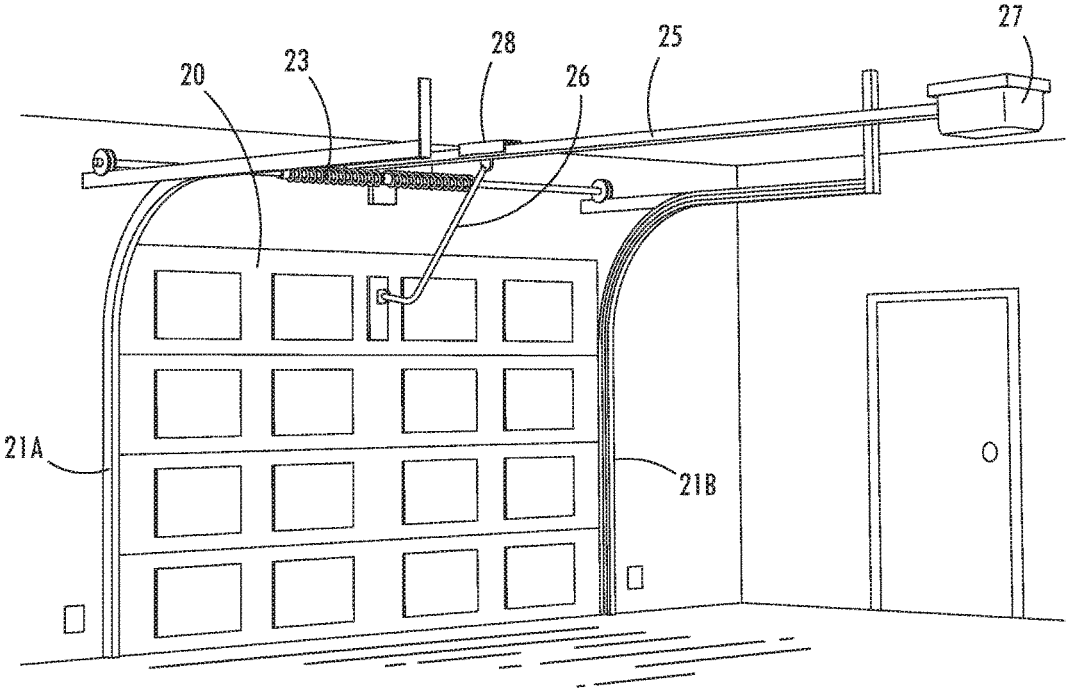
FIG. 3 depicts a barrier system in accordance with one embodiment.
Figure 4:
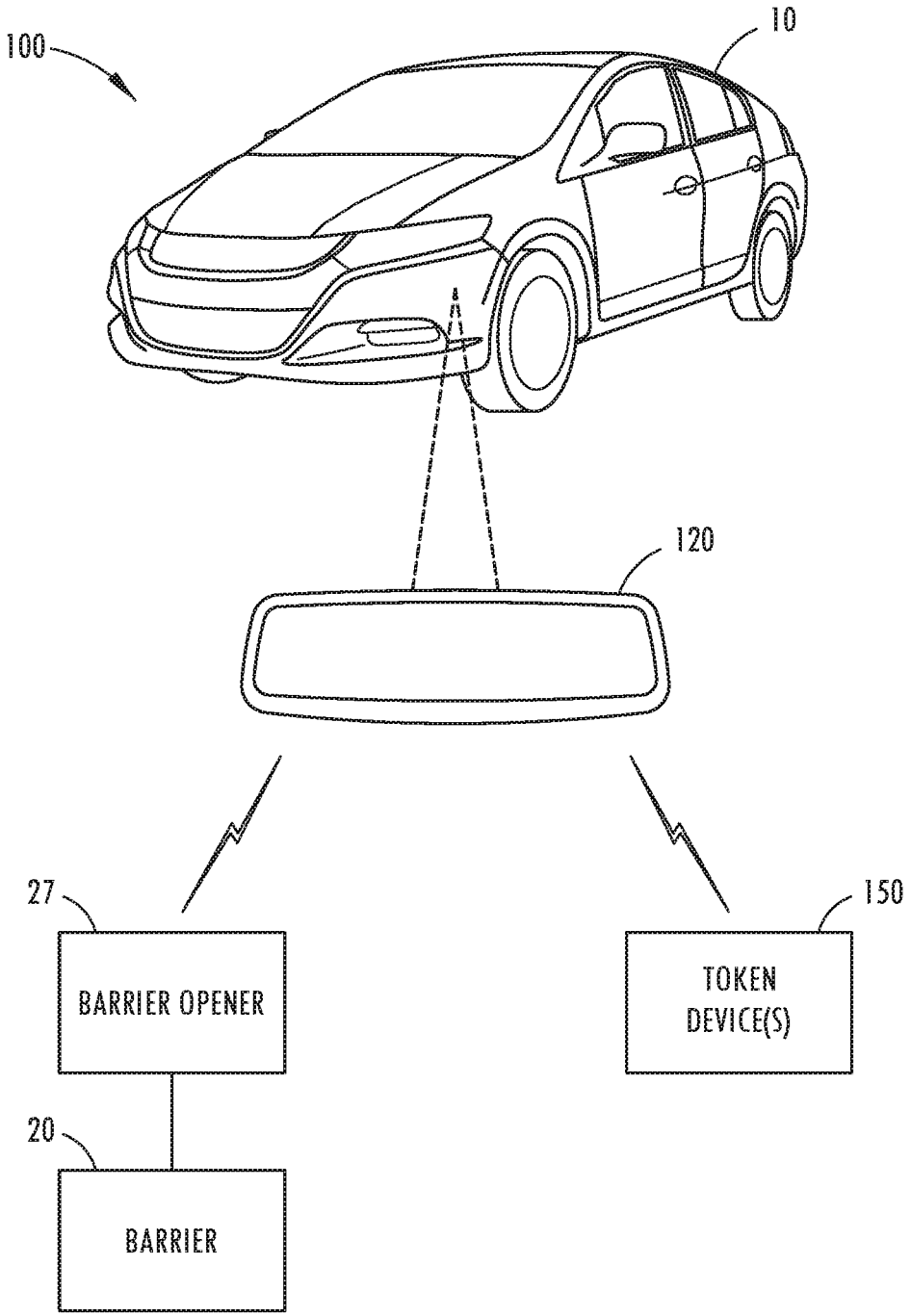
FIG. 4 depicts the communication system of FIG. 1 incorporated into a vehicle according to one embodiment.

In the illustrated embodiments of FIGS. 3 and 4, a communication system 100 with the remote device 120 integrated into the vehicle 10 and configured for operation with the barrier operator 27 is shown. More specifically, the remote device 120 is shown integrated into a rearview mirror—although it should be understood that the remote device 120 may be integrated into any part or parts of the vehicle 10. The remote device 120 may be configured to communicate wirelessly with the barrier operator 27, which in turn is capable of controlling operation of the barrier 20. The remote device 120 may communicate commands to the barrier operator 27 via a communication channel, which may be disabled or suppressed until after the remote device 120 has obtained the identification information from the remote token 150.

For purposes of disclosure, the communication system 100 is described as communicating with a single barrier operator, but it should be understood that the embodiments herein may operate in conjunction with multiple barrier operators. For instance, the communication system 100 may be configured to communicate with two separate garage door operators, or a front gate controller and a garage door operator. Although the communication system 100 is described herein in conjunction with communicating with a barrier operator 27, the communication system 100 may communicate with other devices or auxiliary devices, such as building automation devices or other wirelessly accessible devices such as electronic toll collection systems and Bluetooth® capable smartphones, or any combination thereof. The communications may include a request for an equipment operation or action from the barrier operator 27.

The barrier operator 27 may be any type of operator, such as the MyQ garage door opener manufactured by Chamberlain Corporation that is capable of operating the barrier 20 to move from a first position to a second position. As an example, the barrier operator 27 may be configured to move the barrier 20 from a closed position to an open position. The barrier operator 27 may be coupled to a barrier driver 25 configured to facilitate movement of the barrier 20. An example of this configuration can be seen in FIG. 3, which depicts a garage door operator system. The barrier 20 in the illustrated embodiment is a paneled garage door guided by door rails 21*a-b*, and the barrier operator 27 is a head unit mounted to the ceiling of the garage. The barrier driver 25 includes a releasable trolley 28 with an arm 26 coupled to the garage door. The releasable trolley 28 may be actuated by the barrier operator 27, via a chain or belt coupled to the releasable trolley 28, to effect movement of the garage door from a closed position to an open position along the door rails 21*a-b*. Conversely, the barrier operator 27 may control movement of the releasable trolley 28 to move the garage door from the open position to the closed position along the door rails 21*a-b*. A spring 23 coupled to the garage structure and the garage door may facilitate movement between the open and closed positions.

The barrier operator 27 may include the barrier operator 27 capable of wirelessly communicating with the remote device 120. Wireless communication may be 2-way or 1-way, and may include communications according to one or more control packet formats.

The communication system 100 may be trained or configured to store in memory communication parameters for use with more than one type of control packet formats. Storage of the communication parameters may be conducted during an association phase or pairing phase with the barrier operator 27, where the communication system 100 is paired with the barrier operator 27. For instance, the remote device 120, as discussed herein, may sniff communications from another device and determine that the barrier operator 27 responds to communications according to more than one type of control packet format, e.g., a KeeLoq-type of packet and a proprietary AES-based type of packet.

V. Method(s) of Operation, Including Pairing and Lockout Enable

A method according to one embodiment of the present disclosure includes providing a remote token 150. To enter into a passive lockout, the end user may obtain access to a remote device 120 (e.g., a HomeLink device). On entering the passive lockout for the first time, the remote device 120 may read the identification information stored on the remote token 150 (e.g., the RFID) and store this identification information in non-volatile memory of the remote device 120. The storage of this identification information may be used to signal or as an indication that passive lockout is enabled. After completion of reading the identification information from the remote token 150, the remote device 120 may indicate the end user via display or LED that passive lockout is activated successfully (or in the case that it failed, indicate a failure).

Activation or enrollment of passive lockout may be achieved in a variety of ways depending on the application. Examples include activation of one or more buttons of the user interface 122, including unique activation of one or more buttons to initiate communications and reading of the identification information from the remote token 150. The unique activation may include the user pressing and holding one or more buttons for a pre-defined duration, such as 1, 2 or 25 seconds. For example, the system may require the user to hold buttons identified as "1" and "2" for a period of 25 seconds in order to activate the enrollment procedure.

Another example of activation or enrollment of passive lockout may be achieved via a command control interface that operates on the vehicle communication bus. A service identifier (SID) for the vehicle communication bus may be associated with initiating the process for enrolling the remote token 150 with the remote device 120. The service identifier may be linked to one or more buttons of the vehicle's human machine interface console. Activation of the one or more buttons may initiate transmission of the SID across the vehicle communication bus, which the remote device 120 may monitor. Receipt of the SID in the remote device 120 may trigger the enrollment process for a remote token 150 in proximity to the remote device 120.

After the passive lockout mode is enabled, the remote device 120 may wait to receive further input from a user. In response to a channel activation (e.g., a button press requesting communication to the barrier operator via the channel), the remote device 120 may transmit a request (e.g., an interrogation signal) to elicit a response from any remote tokens 150 present in range of the request. This request may include transmission at a frequency in the 865-868 MHz (Europe) or 902-928 MHz (North America) range to energize any remote tokens 150 in range of the request. In one embodiment, after the request is transmitted, the remote device 120 may transition to a receive mode and read identification information from any remote tokens 150 in range of the request. If the identification information received in this mode matches identification information previously stored in the enrollment process, the activated channel may be enabled for transmission. If the identification information does not match, an indication of the mismatch may be displayed to the end user that the channel is locked via the display 124 (or LED).

Exiting from the passive lockout may be allowed in one or more ways, depending on the application. One way includes reading the identification information from the remote token 150, indicating presence of the remote token 150 in range of the remote device 120. Another way includes a fail-safe in case the user no longer has possession of the remote token 120. Activation of the exit sequence may be initiated in the same manner as activating the enrollment sequence (e.g., a user pressing a button or receipt of a command control via the vehicle communication bus).

In one embodiment, in response to initiation to exit passive lockout, an attempt may be made to read identification information from a remote token 150 in accordance with one or more embodiments described herein. If the remote token 150 responds with the identification information, indicating the remote token 150 is in proximity to the remote device 120, and the identification information corresponds to the identification information stored in memory of the remote device 120, the remote device 120 may exit the passive lockout mode. At this point, transmission of communications over a trained channel will no longer require a read of the remote token 150.

If no remote token 150 responds to a request for identification information during the exit sequence, or the identification information received in response to the request does not match the identification stored in memory of the remote device 120, the remote device 150 may erase all or some of the trained channels, or confirm with the user for erasure of one or more trained channels, to disable the passive lockout mode.

Figure 5:
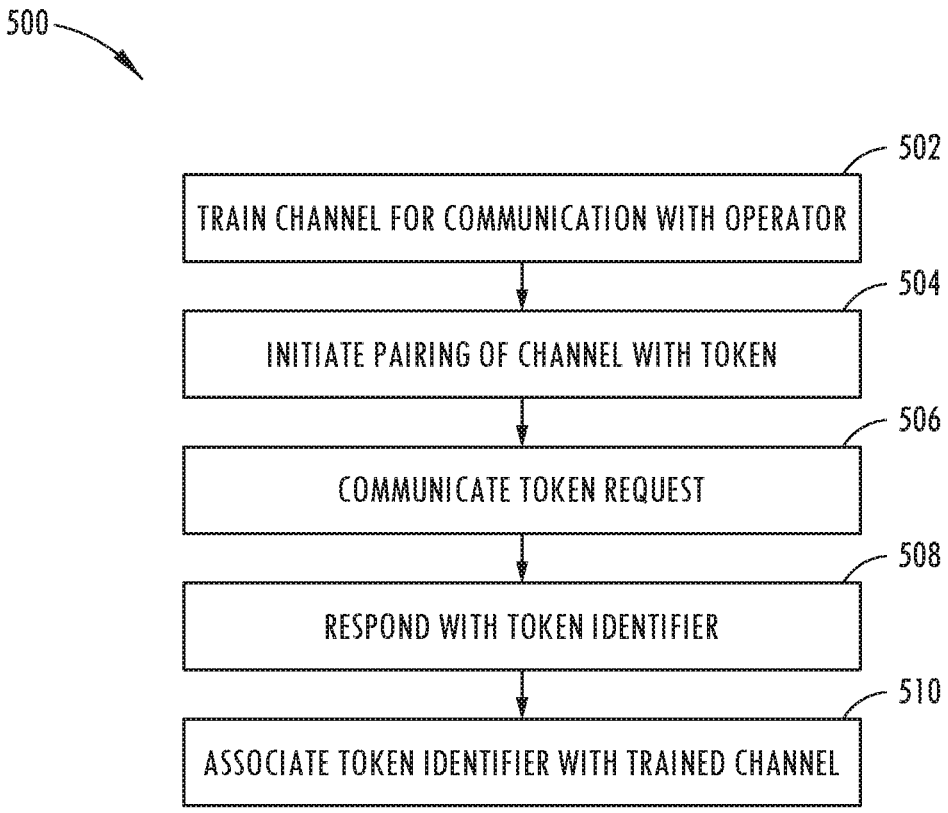
FIG. 5 shows a method of pairing a remote token with a remote device according to one embodiment.

A method according to one embodiment of the present disclosure is shown in FIG. 5 and generally designated 500. The method 500 may include pairing a remote device 120 with the barrier operator 27. This pairing may include training the remote device 120 to communicate with the barrier operator 27 according to one or more control packet formats utilized by the barrier operator 27. In some cases, pairing the remote device 120 may include accessing a physical input of the barrier operator 27 to initiate pairing of the barrier operator 27 with another device. Physical access to the input may be considered sufficient authorization to enable pairing of the barrier operator 27 with a device, such as the remote device 120.

In the illustrated embodiment, in step 502, the remote device 120 may be trained to communicate with the barrier operator 27. As described herein, the training phase may include sniffing communications between another device and the barrier operator 27 to determine one or more control packet formats possibly utilized by the barrier operator 27. The training phase may not try to replicate the other device, but rather may enable the remote device 150 to communicate and pair with the barrier operator 120 in a manner similar to the other device. After the remote device 120 determines one or more control packet formats for use with the barrier operator 27, the controller of the remote device 120 may attempt to pair or establish a communication channel (e.g., a trained communication channel) with the barrier operator 27. Pairing between the barrier operator 27 and the remote device 120 may include one-way communication from the remote device 120 to the barrier operator 27 or two-way communication therebetween. The pairing may allow the remote device 120 to direct the operation of the barrier operator 27.

It should be understood that training the remote device 120 to communicate with the barrier operator 27 may be optional. For instance, in one embodiment, the remote device 120 may be pre-configured to communicate and pair with the barrier operator 27 to utilize a communication channel for transmitting instructions or commands to the barrier operator 27.

The method 500 may include pairing a communication channel for the barrier operator 27, and pairing the communication channel with the remote token 150 to enable passive lockout of the communication channel in step 504. It should be noted that the passive lockout may not disable or prevent the remote device 120 from re-pairing to establish another channel with the barrier 27 or receiving communications from the barrier 27 in the remote device 120. For instance, the remote device 120 may receive status updates from the barrier operator 27 via the communication channel despite the passive lockout being active. The passive lockout may apply to all or a subset of commands possibly communicated to the barrier operator 27 according to a control packet format used by the barrier operator 27.

Pairing with the remote token 150 may include providing user input to the user interface 122 to initiate pairing of a communication channel with the remote token 150. In one embodiment, in step 506, after the user input to request pairing is provided, the remote device 120 may communicate a request in the form of an interrogation signal to any remote tokens 150 in proximity to the remote device 120. The interrogation signal, as discussed herein, may be a carrier wave that, itself, forms a request or data may be modulated on the carrier wave to communicate the request. In step 508, the remote token 150 that receives the request may respond with its identification information stored in identification storage 168.

In step 510, the identification information received from the remote token 150 by the remote device 120 may be stored in memory 135 of the remote device 120 and associated with the communication channel for authorization purposes at a later time. For instance, in response to a future request to transmit a command on the communication channel, the remote device 120 may transmit an interrogation signal to which the remote token 150 (if present) responds. The remote token's 150 response or token data in this embodiment is the identification information, which the remote device 120 may compare to the identification information previously stored in memory to authorize use of the communication channel.

Figure 6:
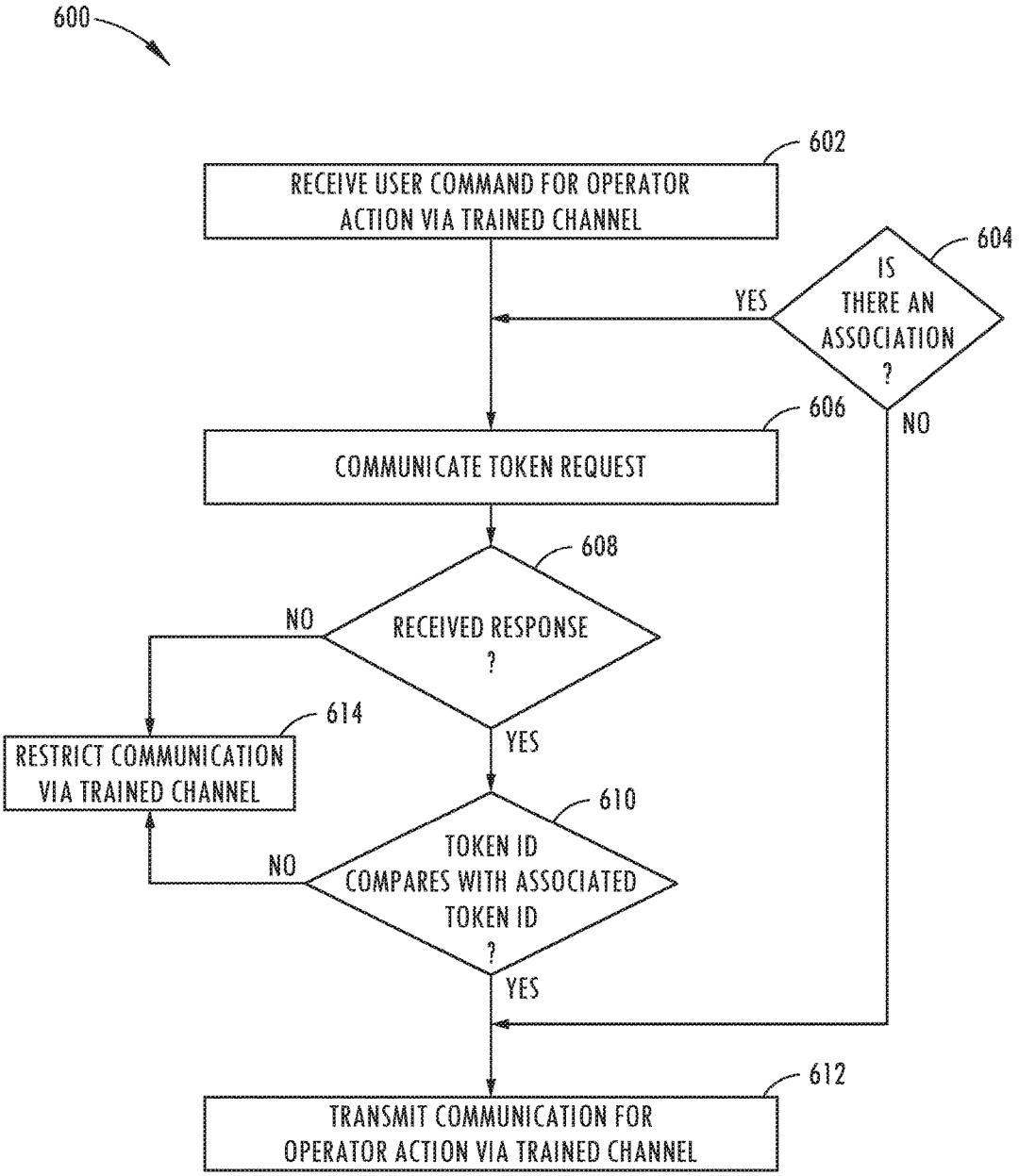
FIG. 6 shows a method of communicating with a barrier operator according to one embodiment.

A method of communicating with a barrier operator 27 in accordance with one embodiment is shown in FIG. 6 and designed 600. The method 600 includes receiving in the remote device 120 a user command to transmit a command to the barrier operator 27 via a communication channel previously established between the remote device 120 and the barrier operator 27 in step 602. The user command may be received via the user interface 122. In response to receipt of the user command, the remote device 120 may determine if passive lockout is enabled for the communication channel in step 604. If passive lockout is enabled, the remote device 120 may communicate a token request or interrogation signal in step 606. Additionally, or alternatively, the remote device 120 may detect presence of the remote token 150 in proximity to the remote device 120. If passive lockout is not enabled, the remote device 120 may communicate the command in step 612.

After transmitting a token request, the remote device 120 may wait to receive a response from one or more remote tokens 150 in step 608. The responses received may include identification information as discussed herein. If no response is received, the remote device 120 may restrict the communication channel to prevent transmission of the command initiated by the user via the user interface 122 in step 614.

If one or more responses are received, the remote device 120 may determine whether the information included in the one or more responses corresponds to identification information stored in the memory 134 and associated with the communication channel in step 610. If the determination is negative—i.e., there is no correspondence with any of the responses for the communication channel—the remote device 120 may restrict the communication channel to prevent transmission of the command. In other words, if there is no correspondence, the passive lockout mode may remain enabled in step 614.

On the other hand, if the information received in the one or more responses corresponds to the identification information stored in the memory 134 and associated with the communication channel, the remote device may disable the passive lockout to enable transmission of the command to the barrier operator 27 in step 612.

Figure 7:
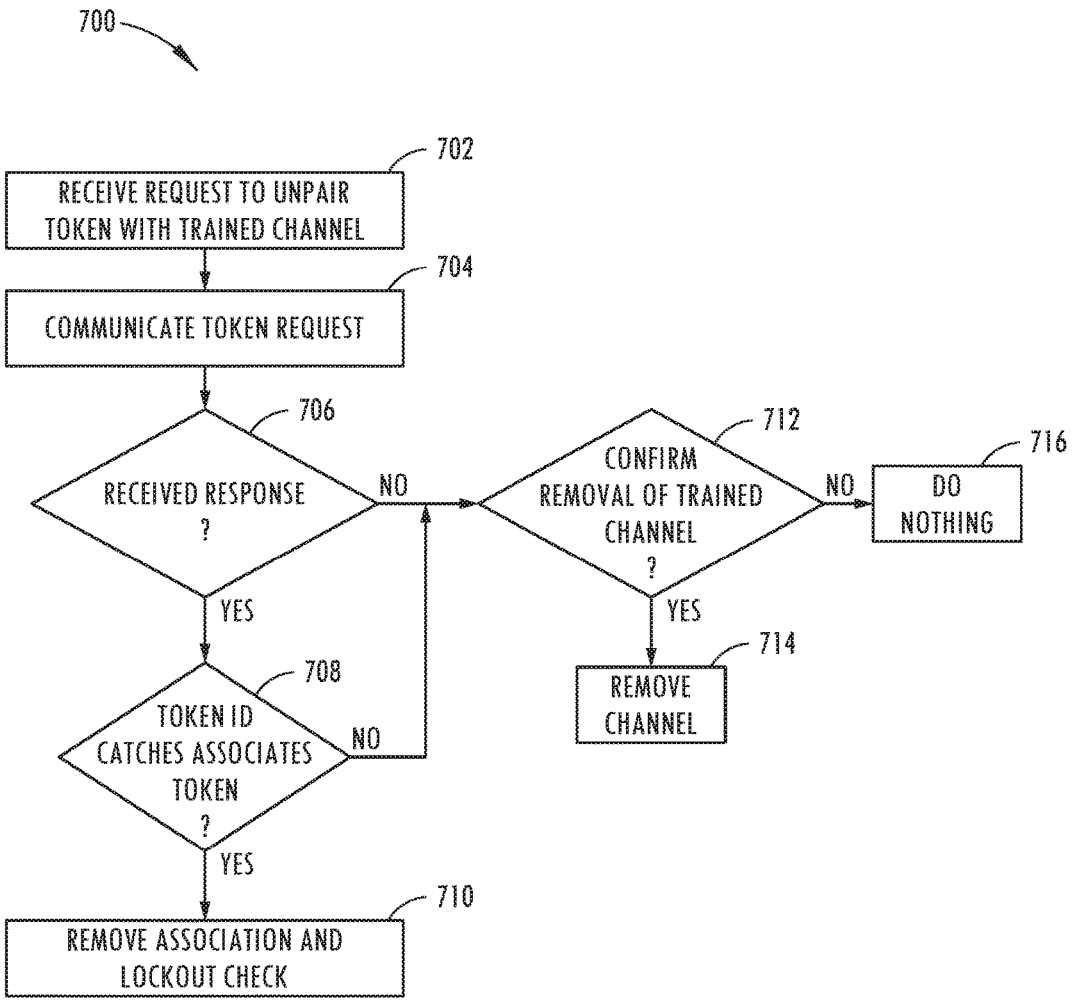
FIG. 7 shows a method of unpairing a remote token and a remote device according to one embodiment.

A method of unpairing or disassociating passive lockout with a communication channel in accordance with one embodiment is shown in FIG. 7 and designated 700. After a communication channel is associated with passive lockout, the communication channel may be restricted from communicating one or more commands to the barrier operator 27 unless an associated remote token 150 communicates information authorizing transmissions. A user at one point may desire to disassociate this capability from the communication channel. To prevent unauthorized access to the communication channel, disassociation may be enabled only if at least one criteria is satisfied, such as receipt of a response from the remote token 150 associated with the communication channel.

In the illustrated embodiment, the user may provide a request via the user interface 122 to unpair one or more remote tokens 150 from a communication channel in step 702. In response to this request, the remote device 120 may communicate a token request or interrogation signal in step 704. In steps 706 and 708, if a response is received from the remote token 150, the remote device 120 may determine if the response is presently associated with the communication channel. In step 712, if no response is received, or if the response received is not associated with the communication channel, the remote device may prompt the user to decide whether to remove the communication channel from memory 134 (that is, to unpair the remote device 120 from communications with the barrier operator 27). In step 716, if the user does not want to unpair the remote device and barrier operator 27, nothing is done. Otherwise, if the user confirms she wants to unpair the remote device 120 and barrier operator 27, the remote device 120 may do so in step 714. After the remote device 120 is unpaired from the barrier operator 27, the remote device 120 is unable to communicate with the barrier operator 27 using the now removed or deleted communication channel. Either another communication channel would need to be used or another communication channel would need to be established between the barrier operator 27 and the remote device 120 in order to effectively communicate commands to the barrier operator 27.

If a response received from a remote token 150 is associated with a communication channel stored in the memory 134, in step 710, the remote device 120 may disassociate the remote token 150 from the communication channel to enable use of the communication channel without passive lockout capabilities.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

What is claimed is:

1. A remote device configured to control operation of a barrier operator, said remote device comprising:

memory configured to store remote token information relating to a remote token, said memory configured to store one or more communication parameters pertaining to controlling operation of the barrier operator;

a communication system configured to transmit communications to the barrier operator according to the one or more communication parameters, said communication system configured to transmit a request for information to the remote token; and a controller operably coupled to the communication system, said controller configured to direct the communication system to transmit the request for information to the remote token, said controller configured to direct said communication system to transmit a command to the barrier operator according to the one or more communication parameters in response to receipt of information from the remote token that corresponds to the remote token information stored in memory.

2. The remote device of claim 1 wherein the remote token is an RFID device, wherein said request includes an interrogation signal transmitted from the remote device, and wherein said RFID device transmits information corresponding to the remote token information via modulations imposed on the interrogation signal.

3. The remote device of claim 1 wherein the remote token information is an identifier for the remote token, and wherein information received from the remote token is the identifier.

4. The remote device of claim 3 wherein the information received from the remote token is encrypted according to a key and an encryption algorithm.

5. The remote device of claim 4 wherein the key is a pre-shared key stored in both memory of the remote token and the memory of the remote device.

6. The remote device of claim 1 wherein the controller of the remote device is configured to pair the remote device with the barrier operator to establish a communication channel for directing operation of the barrier operator.

7. The remote device of claim 6 wherein the controller is configured to learn a control protocol for communicating with the barrier operator by sniffing communications from another device to the barrier operator, wherein the controller pairs with the barrier operator by communicating according to the control protocol learned from sniffed communications.

8. The remote device of claim 1 wherein the controller is configured to establish one or more channels of communication for communicating with one or more barrier operators, and wherein the controller is configured to associate the remote token information from the remote token with at least one of the one or more channels.

9. The remote device of claim 8 wherein the controller is configured to associate a plurality of remote tokens with at least one of the one or more channels.

10. The remote device of claim 8 wherein the controller is configured to restrict transmission of communications on the one or more channels of communication until after information received from the remote token is determined to correspond with the remote token information stored in memory.

11. A remote token configured to communicate with a remote device for wirelessly directing operation of a barrier operator, said remote token comprising:

memory configured to store identification information pertaining to an identity of the remote token;

a communication system configured to communicate wirelessly with the remote device; and a controller operably coupled to said communication system, said controller configured to direct said communication system to wirelessly respond to a request from the remote device with token data that is based on the identification information stored in memory, wherein the token data authenticates the remote token to the remote device to authorize the remote device to wirelessly direct operation of the barrier operator.

12. The remote token of claim 11 wherein the communication system is an RFID communication system configured to communicate by modulating an interrogation signal received from the remote device.

13. The remote token of claim 11 wherein the token data corresponds to authentication information stored in the remote device, wherein the authentication information pertains to enabling transmission of communications to the barrier operator via a communication channel.

14. The remote device of claim 11 wherein the controller is configured to pair with the remote device in response to a pair communication request received from the remote device by communicating the token data.

15. A method of controlling an operation of a barrier operator, said method comprising:

providing a remote device for communicating a command to the barrier operator via communication channel;

providing a remote token separate from the remote device;

receiving an input request to transmit the command to the barrier operator;

communicating a token request from the remote device to the remote token;

in response to receipt of the token request, transmitting token data from the remote token to the remote device;

determining if the token data is indicative of authorization for the remote device to transmit the command to the barrier operator via the communication channel; and based on said determining indicating the remote device is authorized to transmit the command, transmitting the command from the remote device to the barrier operator.

16. The method of claim 15 comprising establishing the communication channel with the barrier operator for communicating the command.

17. The method of claim 15 wherein said establishing includes training the remote device to communicate with the barrier operator via the communication channel; and comprising associating the token data with the communication channel in a setup mode.

18. The method of claim 15 comprising restricting transmission of communications on the communication channel until after the remote device determines if the token data is indicative of authorization for the remote device to transmit the command.

19. The method of claim 15 comprising training the remote device to communicate on a second communication channel with the barrier operator.

20. The method of claim 15 wherein said communicating the token request includes transmitting an interrogation signal to the remote token; and comprising modulating the interrogation signal in accordance with the token data to transmit the token data to the remote device.

* * * * *